US007241147B2

(12) United States Patent
Lloyd et al.

(10) Patent No.: US 7,241,147 B2
(45) **Date of Patent: *Jul. 10, 2007**

(54) MAKING ELECTRICAL CONNECTIONS BETWEEN A CIRCUIT BOARD AND AN INTEGRATED CIRCUIT

(75) Inventors: Shawn L. Lloyd, Tigard, OR (US); John G. Oldendorf, Portland, OR (US); Michael Kochanowski, Portland, OR (US); Scott A. Gilbert, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 14 days.

This patent is subject to a terminal disclaimer.

(21) Appl. No.: 10/822,572

(22) Filed: Apr. 12, 2004

(65) Prior Publication Data

US 2005/0227509 A1 Oct. 13, 2005

(51) Int. Cl.
*H01R 13/40* (2006.01)

(52) U.S. Cl. ..... 439/66; 439/91; 439/591

(58) Field of Classification Search ..... 439/66, 439/91, 591

See application file for complete search history.

(56) References Cited

U.S. PATENT DOCUMENTS

| | | | | |
|---|---|---|---|---|
| 5,785,538 | A * | 7/1998 | Beaman et al. | 439/91 |
| 5,829,988 | A * | 11/1998 | McMillan et al. | 439/70 |
| 5,955,888 | A * | 9/1999 | Frederickson et al. | 324/761 |
| 6,012,929 | A * | 1/2000 | Matsumura | 439/70 |
| 6,174,172 | B1 * | 1/2001 | Kazama | 439/66 |
| 6,178,629 | B1 * | 1/2001 | Rathburn | 29/843 |
| 6,541,991 | B1 * | 4/2003 | Hornchek et al. | 324/755 |
| 6,716,037 | B2 * | 4/2004 | Kung et al. | 439/66 |
| 6,981,881 | B2 * | 1/2006 | Adachi et al. | 439/71 |
| 7,104,803 | B1 * | 9/2006 | Lloyd et al. | 439/66 |
| 2004/0166702 | A1 * | 8/2004 | Higashi | 439/66 |
| 2006/0216957 | A1 * | 9/2006 | Lloyd et al. | 439/66 |

* cited by examiner

*Primary Examiner*—James R. Harvey
(74) *Attorney, Agent, or Firm*—Trop, Pruner & Hu, P.C.

(57) ABSTRACT

A socket may receive both ball grid and land grid array packages. Thus, in some embodiments, the early package prototypes, without solder balls, may be packaged in the same socket design that is ultimately used for production devices using ball grid array packaging. Both land grid array and ball grid arrays may be self-centered on the socket in some embodiments. An S-shaped spring contact may be utilized to electrically connect to either solder balls or lands in a wiping action.

15 Claims, 2 Drawing Sheets

MAKING ELECTRICAL CONNECTIONS BETWEEN A CIRCUIT BOARD AND AN INTEGRATED CIRCUIT

BACKGROUND

This invention relates generally to connecting integrated circuit packages to circuit boards.

A socket is a device that acts as an interface between a packaged integrated circuit and a printed circuit board. A socket provides both an electrical and a mechanical interface between the printed circuit board and the integrated circuit package.

Conventionally, sockets have been dedicated to certain package technologies. For example, sockets useful with ball grid array packages are dedicated in the sense that they do not receive land grid array packages and vice versa. As a result, it is necessary to change out the sockets when using different packages, even when the packaged die is the same.

In some cases, a prototype of an integrated circuit die may be packaged in a land grid array package. Later in development, the same integrated circuit die may be packaged in a ball grid array package. Conventionally, different sockets are needed for each of these stages.

Thus, there is a need for better ways for implementing sockets for connecting integrated circuits to printed circuit boards.

DETAILED DESCRIPTION

Figure 1:
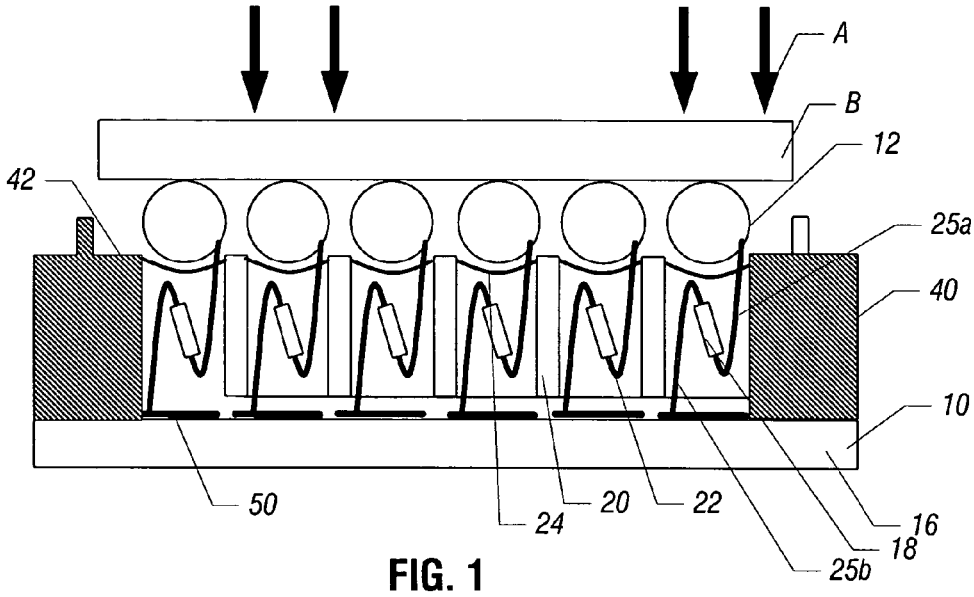
FIG. 1 is an enlarged, cross-sectional view of one embodiment of the present invention.

Referring to FIG. 1, a socket 40 may receive a ball grid array package B that is pressed downwardly, as indicated by the arrows A, into the socket 40. The socket 14 may include an alignment surface 24, an S-shaped spring 22, and partitions 20. Each spring 22 may include a connector portion 18 and a pair of spring arm portions 25 extending therefrom. The connector portion 18 connects the portions 25 to one another and mounts the spring 22 to the socket 14.

Figure 3:
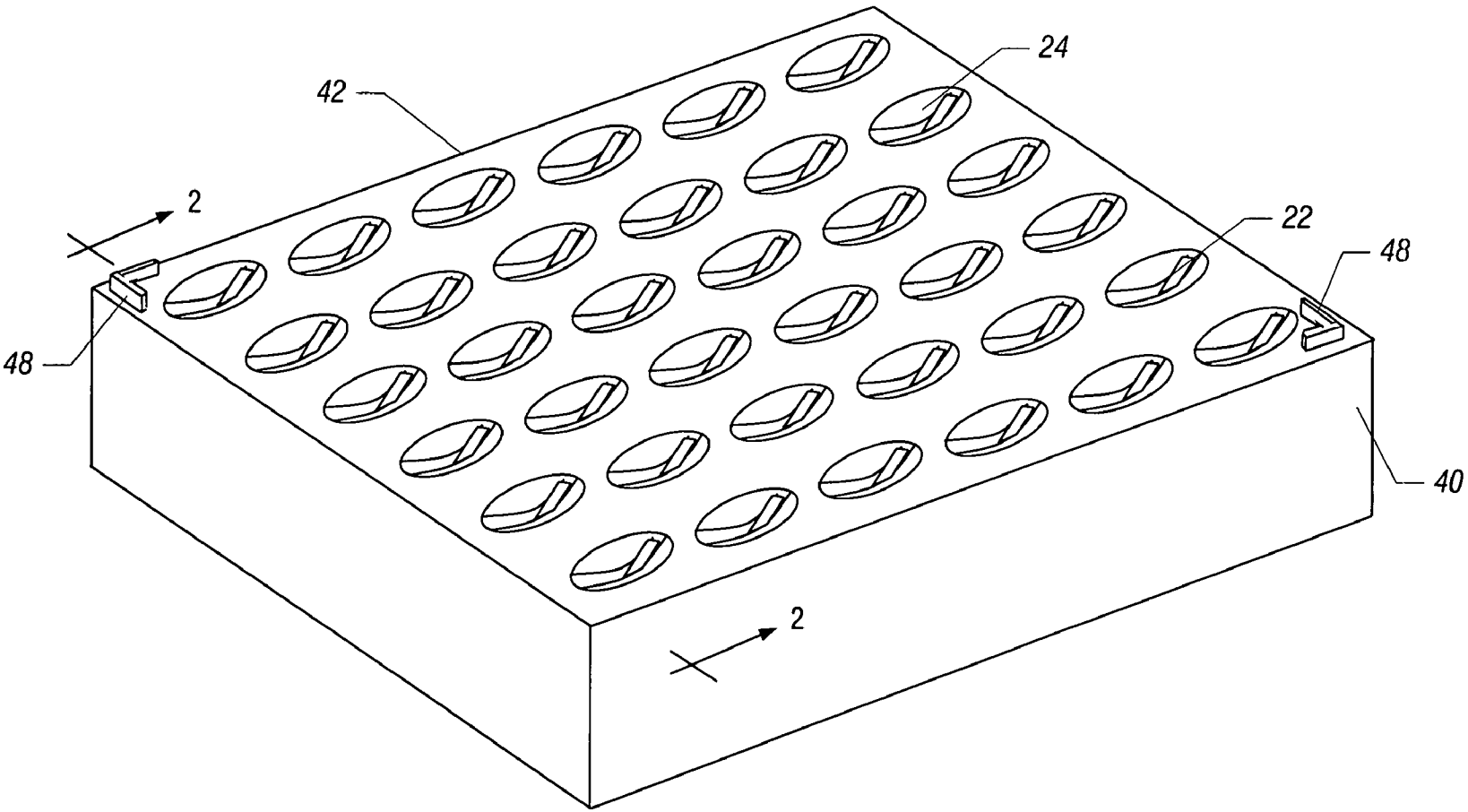
FIG. 3 is an enlarged, top perspective view of one embodiment of the present invention.

As better shown in FIG. 3, the alignment surfaces 24 may be formed as circular openings in the upwardly facing surface 42 of the socket 14 in one embodiment of the present invention. The surfaces 24 may be sized to receive and align a ball grid array package B (FIG. 1) and, particularly, its solder balls 12. Thus, the surfaces 24 may be arranged to seat the balls 12 in a desired organized configuration on the socket 40.

The upper S-shaped spring 22 portion 25*a* may then make a wiping action contact on the balls 12 as shown in FIG. 1. The springs 22 and, particularly, the upper arm portions 25*a* and, to a lesser extent, the lower arm portions 25*b* may deflect away as the ball 12 is inserted into each ball receiving surface 24. As a result of wiping contact between the upper spring arm portion 25*a* and the ball 12, good electrical connection can be made.

The socket 40 may electrically connect to a printed circuit board 10 in one embodiment of the present invention. The circuit board 10 may, for example, be a motherboard. The board 10 may have a number of lands 50 formed thereon. The lower spring 22 portions 25*b* may make wiping electrical contact on the lands 50 in one embodiment of the present invention.

Figure 2:
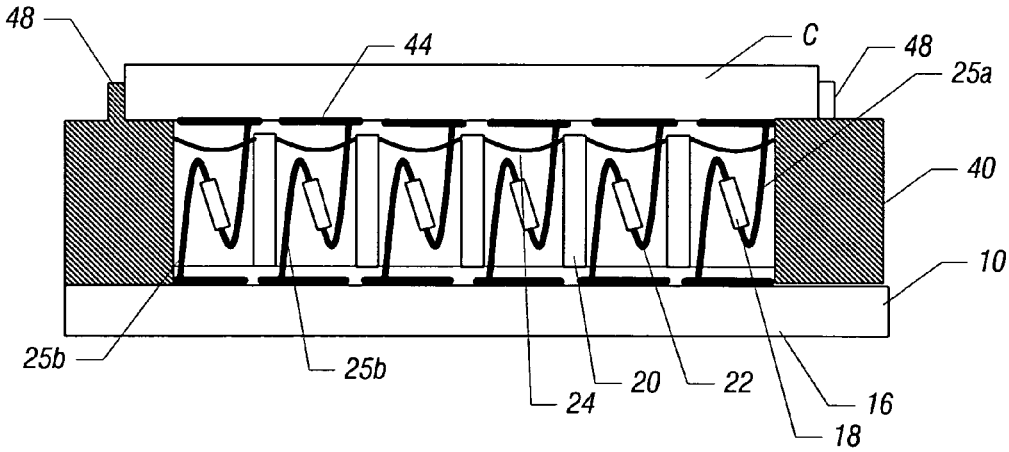
FIG. 2 is an enlarged, cross-sectional view of another embodiment of the present invention taken generally along the line 2-2 in FIG. 3.

Referring to FIG. 2, the socket 40 can also receive a land grid array package C. In this case, the land grid array package C has a plurality of downwardly facing lands 44. The lands 44 are contacted by the upper spring arm portions 25*a*. The rest of the connection is similar to that described with respect to FIG. 1.

Referring to FIGS. 2 and 3, in the case of land grid array package, a L-shaped corner alignment feature 48, on two opposed corners of the surface 42, in one embodiment, may be utilized to physically align the land grid array package C with the socket 40. Thus, the alignment features 48 may provide (for land grid array packages C) a similar alignment function to that provided by the surfaces 24 (for the ball grid array packages B).

As shown in FIG. 2, the package C may be engaged between the features 48 on the socket 40. Because there are no solder balls on the package C, it sits lower and directly on the surface 42 so that it engages the features 48. The features 48 may have a height less than the height of a solder ball 12 so that the feature 48 does not interfere with ball grid array package B.

In some embodiments, the pitch and diameter of the surfaces 24, formed in the surface 42, may be varied to match a particular ball grid array package B pitch and ball diameter.

Thus, self-centering and self-aligning attachment of either ball grid array or land grid array packages may be achieved with the same socket 40 in one embodiment of the present invention. Thus, different generations of a chip set or integrated circuit package may be utilized with the same socket design. The socket 40 can accommodate early land grid array packages without requiring solder balls, in order to speed the testing transition in some embodiments. The same socket can then be used for the next generation integrated circuit with solder balls without the need for socket replacement. This is because the socket may be designed to accommodate and align both land grid array and ball grid array packages in some embodiments.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A socket comprising:

an upper surface with a solder ball receiving aperture formed therein; and an S-shaped spring contact arranged in said aperture, said contact adapted to make wiping electrical contact with a solder ball inserted into said aperture at a point spaced from the vertical center line of said solder ball said socket includes a body including an upwardly extending protrusion, said protrusion having a height less than the height of a solder ball for a ball grid array package.

2. The socket of claim 1 wherein said spring contact is adapted to make wiping electrical contact with lands.

3. The socket of claim 1 wherein said S-shaped spring contacts include opposed contact arms, one of which extends upwardly and the other which extends downwardly.

4. The socket of claim 1 wherein socket includes a body, said body having a plurality of solder ball receiving apertures formed therein.

5. The socket of claim 4 including an alignment feature extending upwardly from said body to align a land grid array package with said socket.

6. The socket of claim 1 wherein said spring contact includes an upwardly extending arm to make contact with an integrated circuit package and a downwardly extending arm to make contact with an underlying circuit bard.

7. The socket of claim 5 wherein said alignment feature is L-shaped.

8. The socket of claim 7 including two L-shaped alignment features opposed diagonally from one another on said socket.

9. An electronic device comprising:

a printed circuit board;

a socket coupled to said printed circuit board, said socket including a housing having an upper surface with a solder ball receiving aperture formed therein and an S-shaped spring contact aligned with said aperture to make wiping electrical contact with a solder ball inserted into said aperture at a point spaced from the vertical center line of said solder ball, said socket includes a body including an upwardly extending protrusion having a height less than the height of a solder ball for a ball grid array package.

10. The device of claim 9 wherein said spring contact includes opposed contact arms, one of which extends upwardly and the other which extends downwardly to contact said printed circuit board.

11. The device of claim 10 wherein said printed circuit board has a land engaged by said spring contact.

12. The device of claim 9 wherein said protrusion is L-shaped.

13. The device of claim 12 including two L-shaped protrusions opposed diagonally from one another on said housing.

14. The device of claim 9 including a ball grid array package engaged on said socket housing.

15. The device at claim 9 including a land grid array package engaged on said socket housing.

* * * * *

UNITED STATES PATENT AND TRADEMARK OFFICE

CERTIFICATE OF CORRECTION

PATENT NO. : 7,241,147 B2
APPLICATION NO. : 10/822572
DATED : July 10, 2007
INVENTOR(S) : Shawn L. Lloyd et al.

It is certified that error appears in the above-identified patent and that said Letters Patent is hereby corrected as shown below:

Column 4:
Claim 9
Lines 1 and 2, “protrusion” should be --protrustion, said protrusion--.

Signed and Sealed this

Twenty-eighth Day of August, 2007

JON W. DUDAS
*Director of the United States Patent and Trademark Office*